United States Patent [19]

Mussler et al.

[11] Patent Number: 4,606,500

[45] Date of Patent: Aug. 19, 1986

[54] RELEASABLE COUPLING ASSEMBLY FOR OSCILLATING WAVE LAWN SPRINKLER

[75] Inventors: Karl J. Mussler, Alta Loma; Alvin F. Godsey, Jr., Corona, both of Calif.

[73] Assignee: Rain Bird Consumer Products Mfg. Corp., Duarte, Calif.

[21] Appl. No.: 655,759

[22] Filed: Oct. 1, 1984

[51] Int. Cl.[4] ..... B05B 3/16

[52] U.S. Cl. ..... 239/242; 285/2

[58] Field of Search ..... 239/242; 464/32; 285/1-3; 403/344, 357, 359

[56] References Cited

U.S. PATENT DOCUMENTS

| | | | |
|---|---|---|---|
| D. 269,367 | 6/1983 | Mackay et al. | D23/8 |
| 2,291,560 | 7/1942 | Rhodes | 403/357 |
| 3,220,655 | 11/1965 | Mattson | 239/242 |
| 3,593,922 | 7/1971 | Standal | 239/242 |
| 4,140,278 | 2/1979 | Troup | 239/242 |
| 4,245,786 | 1/1981 | Abrahamsen et al. | 239/242 |
| 4,379,523 | 4/1983 | Schanz et al. | 239/242 X |

*Primary Examiner*—Jeffrey V. Nase
*Assistant Examiner*—David P. Davidson
*Attorney, Agent, or Firm*—Kelly, Bauersfeld & Lowry

[57] ABSTRACT

An oscillating wave-type lawn sprinkler is provided of the type having a water-powered drive mechanism for angularly oscillating an elongated spray tube generally about its own axis, wherein the drive mechanism has a crank link coupled to the spray tube by an improved releasable coupling assembly. The releasable coupling assembly comprises a C-shaped clamp at one end of the crank link, sized to fit around the spray tube, an indentation in the spray tube, and at least one tab on the interior surface of the clamp for releasingly engaging the indentation. During normal operation, the tab is engaged in the indentation and the angularly oscillatory motion of the crank link is imparted to the spray tube. When the spray tube is subjected to an external rotational force exceeding a predetermined magnitude, the spray tube rotationally disengages the indentation from the tab to move independently of the crank link, thereby preventing damage to the drive mechanism. Normal engagement of the spray tube with the crank link is restored by manually rotating the spray tube until the indentation returns to alignment with the crank link tab.

19 Claims, 6 Drawing Figures

RELEASABLE COUPLING ASSEMBLY FOR OSCILLATING WAVE LAWN SPRINKLER

BACKGROUND OF THE INVENTION

This invention relates to an improved releasable coupling assembly for connecting a spray tube to a drive mechanism in an oscillating wave lawn sprinkler. More specifically, the releasable coupling assembly of this invention comprises an improvement over the releasable coupling means disclosed and claimed in U.S. Pat. No. 4,140,278.

A typical oscillating wave lawn sprinkler includes a water-driven motor for oscillating a spray tube through a prescribed rotational movement generally about its own axis. More particularly, water supplied to the sprinkler flows initially into association with the motor, which provides a rotary output translated in turn through a mechanical linkage to drive the spray tube through an angularly oscillatory motion. This linkage connection to the spray tube is adjustable to provide for spray tube travel through different selected arcuate paths. The spray tube is typically formed from lightweight aluminum and the linkage is typically constructed from lightweight molded plastic, which is subject to breaking when other than rotational drive forces are applied to the sprinkler. Such exterior forces can be generated, for example, by kicking or by inadvertent impact of a ball.

In U.S. Pat. No. 4,140,278, a releasable coupling means is disclosed for connecting the spray tube of an oscillating wave lawn sprinkler to the spray tube linkage means, thereby allowing the spray tube to disengage from the linkage means when the lawn sprinkler is subjected to an external rotational force exceeding a predetermined magnitude. This has the intended benefit of preventing damage to the plastic drive mechanism of the lawn sprinkler; however, a variety of disadvantages have limited the commercial utility of lawn sprinklers constructed in accordance with this patent. For example, the force required to cause the coupling means to disengage from the spray tube is relatively high, resulting in situations wherein sufficient force is applied to the sprinkler to damage the drive mechanism but not to disengage the coupling means. Moreover, the releasable coupling means requires multiple additional structural components including interfitting collars and a sleeve, thereby unduly increasing the cost of the sprinkler and making assembly of the sprinkler more complex. Further, the provision of additional structural components increases the risk of component failure during operation of the sprinkler.

The present invention overcomes the problems and disadvantages of the sprinkler in U.S. Pat. No. 4,140,278 by providing an improved releasable coupling assembly having a minimum number of components for connecting the water-driven drive linkage to the oscillatory spray tube, and for permitting release of the spray tube in response to relatively low disengagement forces.

SUMMARY OF THE INVENTION

The present invention resides in an improved releasable coupling assembly for assuring the disengagement of a spray tube from a drive mechanism in an oscillating wave lawn sprinkler to avoid damage to the drive mechanism when the spray tube is subjected to an external rotational force exceeding a predetermined magnitude. The releasable coupling assembly is inexpensive to incorporate into the sprinkler, is easy to operate, and is less vulnerable to breakage than prior releasable coupling mechanisms.

The improved releasable coupling assembly is incorporated into a conventional lawn sprinkler having a base, a motor housing at one end of the base, a support arbor located at the other end of the base and the spray tube rotatably suspended between the motor housing and the support arbor. The motor housing encases a fluid-driven motor and has a fluid inlet and a fluid outlet for water passage to drive the motor. A drive shaft is attached to and is driven by the motor, and is further coupled to a mechanical linkage which in turn is coupled to the spray tube, thereby allowing the rotational motion of the drive shaft to be transmitted into angularly oscillatory motion of the spray tube. This mechanical linkage, which is conventionally adjustable to permit the spray tube to move through a specified sweep angle, is coupled to the spray tube by the releasable coupling assembly of the present invention. Water exiting the motor housing is discharged through a plurality of small openings in the spray tube to irrigate surrounding vegetation.

In accordance with the present invention, the releasable coupling assembly includes a crank link having a generally C-shaped clamp which opens in a direction toward the spray tube, at least one tab located on an inner surface of the clamp, and an indentation formed in the spray tube. In one embodiment, there are two tabs on the inner clamp surface. The clamp, which has a normal unstressed diameter slightly smaller than that of the spray tube, is constructed of a plastic material or the like having sufficient resilience to yield slightly upon application of pressure, to permit friction fastening about the spray tube.

Once fastened, the clamp exerts constant pressure on the spray tube, thereby holding the clamp in place. The tab on the inner surface of the clamp fits matingly into the indentation in the spray tube, thereby normally maintaining the angular relationship therebetween to rotate the spray tube in cooperation with the linkage. Upon application of an external rotational rotation force exceeding a predetermined magnitude to the spray tube and tending to alter the normal angular alignment between the spray tube and the crank link, the tab slides out of the indentation to permit the spray tube to move independently of the linkage, thereby preventing damage to the drive mechanism. The coupling assembly is re-engaged by manually rotating the spray tube so that the tab within the crank link clamp once again engages the indentation.

Other aspects and advantages of the invention will become apparent from the following detailed description taken in connection with the accompanying drawings which disclose, by way of example, the principles of the invention.

DETAILED DESCRIPTION OF THE PREFERRED EMBODIMENT

Figure 1:
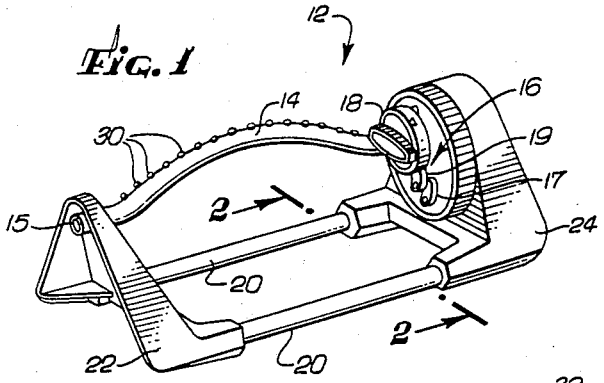
FIG. 1 is a perspective view of a lawn sprinkler of the so-called oscillatory wave type, including an improved releasable coupling assembly embodying the present invention.

As illustrated in the exemplary drawings, the present invention is embodied in a releasable coupling assembly referred to generally by the reference numeral 10 for use in a lawn sprinkler 12 of the oscillating wave type, including an oscillating hollow spray tube 14 driven by a water-driven motor (not shown). The spray tube 14 is coupled by the releasable coupling assembly 10 to a mechanical linkage 16, which in turn is coupled to the motor in order to translate a rotational output of the water-driven motor into angularly oscillatory motion of the spray tube 14. The releasable coupling assembly 10 causes the spray tube 14 to be disengaged from the linkage 16 when the spray tube 14 is subjected to an external rotational force exceeding a predetermined magnitude, thereby preventing damage to the linkage 16 and drive mechanism.

The releasable coupling assembly 10 of this invention advantageously provides a simplified yet improved structure for preventing damage to the drive mechanism, including the mechanical linkage 16 of a lawn sprinkler 12. More specifically, the releasable coupling assembly 10 of this invention comprises a substantial improvement and simplification over the multiple collar and sleeve releasable coupling assembly of the type disclosed in U.S. Pat. No. 4,140,278. In particular, the improved coupling assembly 10 comprises a single releasable element in cooperation with the spray tube 14, making the improved coupling assembly less expensive than prior multi-piece coupling assemblies. Moreover, coupling interaction occurs directly between a crank link 18 of the drive mechanism and the spray tube 14, as opposed to the indirect interaction between two collars, both of which are attached to a sleeve resting on the spray tube, as in U.S. Pat. No. 4,140,278. This permits more reliable control over the actuation and disengagement of the coupling assembly in response to external forces above a predetermined threshold chosen to avoid damage to components of the drive mechanism which are constructed typically from a lightweight plastic.

As illustrated in FIG. 1, the sprinkler in which the releasable coupling assembly 10 is employed conventionally includes a base 20, with a spray tube support arbor 22 secured on one end and a motor housing 24 secured on the other end. Many construction details of the sprinkler are not shown in the accompanying drawings for purposes of simplicity, but may be found in U.S. Pat. No. 4,140,278, incorporated herein by reference.

As shown there, the motor housing 24 conventionally includes a water inlet adapted for connection of a conventional garden hose or the like and a water outlet communicating with the interior of the spray tube 14. The spray tube 14 is formed typically from lightweight aluminum and is journaled at one end to the motor housing 24 and at the other to the support arbor 22. The respective ends of the spray tube 14 are disposed substantially equidistant above the base 20, with the central portion of the spray tube 14 normally arched to a slightly higher elevation. A plug 15 seals the spray tube end journaled to the support arbor 22.

As shown in U.S. Pat. No. 4,140,278, an impeller type water-driven motor is supported within the motor housing 24 and is driven in a known manner to rotatably drive an output drive shaft which protrudes slightly from the interior wall of the motor housing. The protruding drive shaft end is connected to the mechanical linkage 16, which includes a drive crank 17, a connecting arm 19 and the crank link 18. Preferably, these linkage elements are constructed of lightweight plastic or the like.

Figure 3:
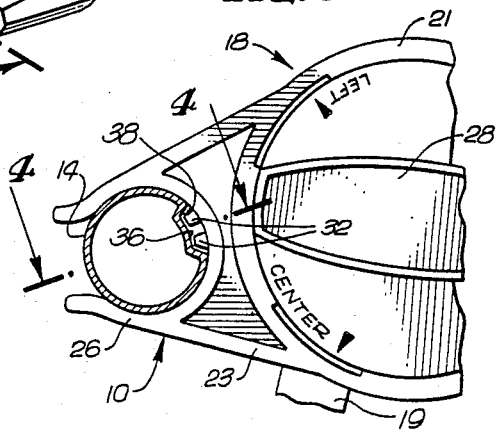
FIG. 3 is a further enlarged, fragmented vertical sectional view similar to portions of FIG. 2 and illustrating construction details of the releasable coupling assembly.
Figure 2:
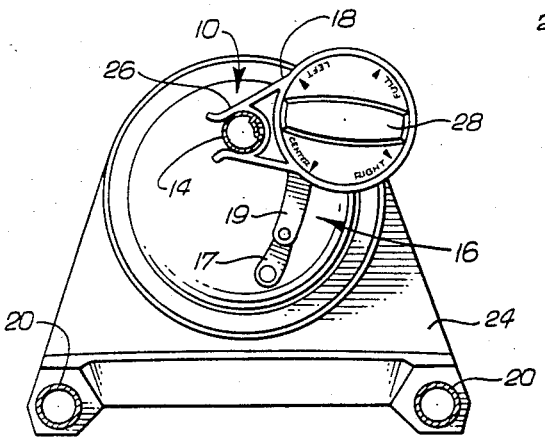
FIG. 2 is an enlarged vertical sectional view taken substantially along line 2—2 of FIG. 1.
Figure 5:
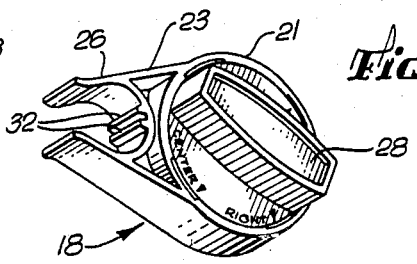
FIG. 5 is a perspective view of a crank link.

As shown best in FIGS. 2, 3 and 5, the crank link 18 has a hollow circular section 21 joined at one side to an intermediate leg 23 joined in turn to a generally C-shaped clamp 26 opening generally toward the spray tube 14. The circular section 21 of the crank link 18 has a circular spray adjustment knob 28 ratcheted into its interior circumferential surface, with the knob 28 being mechanically coupled to the connecting arm 19 of the drive linkage 16. During normal operation, water from a garden hose flows through the motor housing 24 to the motor, after which the water enters the spray tube 14 and is discharged as irrigation sprays through a plurality of nozzles 30 located at substantially equally spaced intervals along the top side of the spray tube 14. By rotating the spray adjustment knob 28 within the circular section 21, the oscillatory roll angle of the spray tube 14 can be adjusted to control the area of spray coverage.

In accordance with the present invention, the releasable coupling assembly 10 includes the C-shaped clamp 26 of the crank link 18, two tabs 32 located on the interior circular surface of the C-shaped clamp 26 and a mating indentation 34 in the spray tube 14. The C-shaped clamp 26 extends through a circular arc of approximately 225 degrees, being interrupted on an interior surface thereof by the two tabs 32. At the end of the arc, the clamp 26 flares slightly to facilitate fastening the clamp 26 around the spray tube 14. The normal unstressed internal diameter of the clamp 26 measured through its circular arc is somewhat smaller than the outside diameter of the spray tube 14. However, the clamp 26 is constructed of a relatively stiff but somewhat resilient material that yields slightly, such as a resilient plastic, so that the clamp can be expanded slightly to fit tightly about the spray tube 14, with a constant pressure exerted on the spray tube 14 by the inner surface of the clamp 26.

Figure 4:
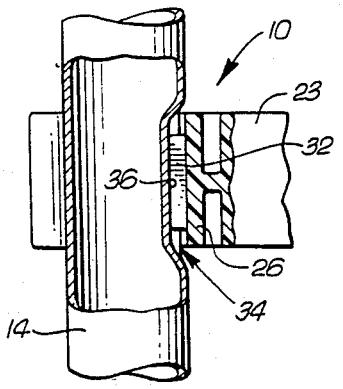
FIG. 4 is a fragmentary sectional view of a portion of the releasable coupling assembly, taken substantially along the line 4—4 of FIG. 3.
Figure 6:
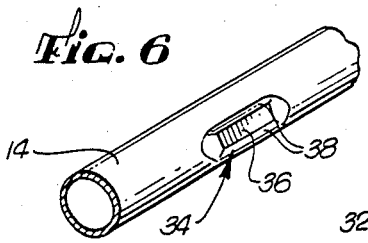
FIG. 6 is a fragmentary perspective view of a portion of a spray tube, including an indentation.

The tabs 32 and the spray tube indentation 34 have generally conforming shapes. As shown in FIG. 6, the indentation 34 has a flat bottom 36 and tapered sidewalls 38 that form an obtuse angle with the flat bottom 36 of the indentation 34. As can be seen in FIG. 5, the tabs 32 each have a generally trapezoidal cross section, so that the outside surfaces of the tabs form an obtuse angle with the inner surface of the clamp 26. Under normal operating conditions, the tabs 32 seat into and engage with the indentation 34 as shown in FIGS. 2 and 3, each tab contacting one side of the indentation 34, thereby coupling the oscillatory rotational movement of the crank link 18 to the spray tube 14. An enlarged view of the clamp 26 fastened about the spray tube 14 is shown in FIG. 4.

The shape of the tabs 32 and the indentation 34 cooperate with the degree of resiliency of the clamp 26 to disengage upon application of an external rotational force exceeding a predetermined magnitude. More particularly, a glancing blow to the spray tube is transformed, at least in part, into a rotational force which is resisted substantially by the tabs 32 engaging the sidewalls 38 of the indentation 34. When this rotational force exceeds the force applied by the clamp 26 to maintain the tabs 32 and indentation 34 in engagement, the tabs 32 slidably rotate or cam out of the indentation 34, thereby permitting the spray tube 14 to yieldably deflect away from the blow without corresponding movement of the linkage 16 and drive mechanism. With the tabs 32 disengaged, the tops of the tabs 32 rest on the cylindrical outside surface of the spray tube 14, and are maintained there by the pressure from the clamp 26 against the spray tube 14.

While the spray tube 14 is deflected from its ordinary operational alignment, the sprinkler 12 can continue to operate, but with the spray tube's 14 water nozzles 30 misdirecting the water spray. Proper operational alignment can be restored by manually rotating the spray tube 14 relative to the clamp 26, until the tabs 32 once again engage the indentation 34.

From the foregoing description, it should be apparent that the present invention provides an improved oscillating wave lawn sprinkler having a spray tube that is capable of withstanding impacts of substantial magnitude without sustaining damage to the drive mechanism. The sprinkler achieves this capability in a relatively inexpensive and uncomplicated, yet highly reliable, fashion.

Although the releasable coupling assembly and lawn sprinkler of the present invention have been described with reference to one preferred embodiment, it will be understood by one skilled in the art that modifications may be made without departing from the spirit and scope of the invention described herein. Accordingly, the invention is not to be limited, except as by the appended claims.

What is claimed is:

1. In an oscillating wave lawn sprinkler of the type having a spray tube, a fluid-driven motor, and a drive linkage, which includes a crank link, said linkage being coupled between the motor and the spray tube for transforming rotational motion of the motor into angularly osillatory motion of the spray tube, the improvement comprising:

a releasable coupling assembly for releasably coupling said drive linkage to said spray tube, said coupling assembly including:

an indentation formed on one of said crank link and said spray tube;

a tab located on the other of said crank link and said spray tube for engaging said indentation, the one of said indentation and said tab on said spray tube being formed integrally with said spray tube; and means for permitting said spray tube to move relative to said crank link by releasably securing said tab in engagement with said indentation for normal angular oscillatory driving of said spray tube by said crank link, said securing means being disengageable from said indentation or tab whenever said spray tube is subjected to an externally applied rotational force exceeding a predetermined magnitude to permit said spray tube to rotate relate to said crank link and move independently of said drive linkage.

2. The improvement as set forth in claim 1 wherein said indentation is formed in said spray tube and said tab is located on said crank link.

3. The improvement as set forth in claim 2 wherein said means for releasably securing said tab in said indentation includes a C-shaped clamp at one end of said crank link for releasable coupling about said spray tube, said tab being formed on an interior surface of said clamp.

4. The improvement as set forth in claim 3 wherein said indentation has a flat bottom and tapered sidewalls forming an obtuse angle with said flat bottom, said tab having a generally trapezoidal cross-section with sides forming an obtuse angle with the interior surface of said clamp.

5. The improvement as set forth in claim 3 further comprising a second tab on said clamp, the two tabs being located such that one tab engages one side of said indentation and the other tab engages the other side of said indentation.

6. The improvement as set forth in claim 3 wherein said indentation is generally rectangular in shape.

7. The improvement as set forth in claim 3 wherein said crank link is formed from a lightweight plastic material.

8. The improvement as set forth in claim 3 wherein said spray tube is formed from aluminum tubing.

9. An oscillatory wave type lawn sprinkler comprising:

an elongated base;

a support arbor located at one end of said base;

a motor housing located at the other end of said base;

an elongated spray tube journaled between said motor housing and said support arbor;

motor means including a rotationally driven drive shaft and a drive linkage coupled between said spray tube and said drive shaft for transmitting the rotational motion of said drive shaft into angularly oscillatory motion of said spray tube, said drive linkage including a drive crank coupled to said drive shaft a connnecting arm coupled to said drive crank, and a crank link coupled to said connecting arm;

a releasable coupling assembly including an indentation formed in one of said crank link and said spray tube, a tab located on the other of said crank link and said spray tube for engaging said indentation, the one of said indentation and said tab on said spray tube being formed integrally with said spray tube, and means for permitting said spray tube to move relative to said crank link by releasably securing said tab in engagement with said indentation for normal angular oscillatory driving of said spray tube by said crank link, said securing means being disengageable from said indentation or tab whenever said spray tube is subjected to an externally applied rotational force exceeding a predetermined magnitude to permit said spray tube to rotate relative to said crank link and move independently of said drive linkage.

10. The sprinkler as set forth in claim 9 wherein said indentation is formed in said spray tube and said tab is located on said crank link.

11. The sprinkler as set forth in claim 10 wherein said means for releasably securing said tab in said indentation includes a C-shaped clamp at one end of said crank link for releasable coupling about said spray tube, said tab being formed on an interior surface of said clamp.

12. The sprinkler as set forth in claim 11 wherein said indentation has a flat bottom and tapered sidewalls forming an obtuse angle with said flat bottom, said tab having a generally trapezoidal cross-section with sides forming an obtuse angle with the interior surface of said clamp.

13. The sprinkler as set forth in claim 11 further comprising a second tab on said clamp, the two tabs being located such that one tab engages one side of said indentation and the other tab engages the other side of said indentation.

14. The sprinkler as set forth in claim 11 wherein said indentation is generally rectangular in shape.

15. The sprinkler as set forth in claim 11 wherein said crank link is formed from a lightweight plastic material.

16. The sprinkler as set forth in claim 11 wherein said spray tube is formed from aluminum tubing.

17. In an oscillating wave lawn sprinkler of the type having a spray tube, a fluid-driven motor, and a drive linkage, which includes a crank link, said linkage being coupled between the motor and the spray tube for transforming rotational motion of the motor into angularly oscillatory motion of the spray tube, the improvement comprising:

a releasable coupling assembly for releasably coupling said drive linkage to said spray tube, said coupling assembly including:

an indentation formed directly in said spray tube;

a tab located on said crank link for engaging said indentation; and means for permitting said spray tube to move relative to said crank link by releasably securing said tab in engagement with said indentation for normal angular oscillatory driving of said spray tube by said crank link, said securing means including a C-shaped clamp at one end of said crank link, said tab being formed on an interior surface of said clamp, said interior surface being formed on a radius at least slightly smaller than half of the outer diameter of the spray tube so that said tab is retained in said indentation by frictional clamping force when said clamp is fastened about said spray tube, said securing means being disengagable from said indentation or tab whenever said spray tube is subjected to an externally applied rotational force exceeding a predetermined magnitude to permit said spray tube to rotate relative to said clamp and move independently of said drive linkage.

18. The improvement as set forth in claim 17 wherein said crank link is formed from a light-weight plastic material.

19. The improvement as set forth in claim 17 wherein said spray tube is formed from aluminum tubing.

* * * * *